US005167103A

United States Patent [19]

Lindal et al.

[11] Patent Number: 5,167,103

[45] Date of Patent: Dec. 1, 1992

[54] LOG-LOOK SIDING CORNER BLOCKS

[75] Inventors: Ronald J. Lindal, Surrey; Benjamin H. Lindal, Barrie, both of Canada

[73] Assignee: Linwood Homes Ltd., Alberta, Canada

[21] Appl. No.: 682,046

[22] Filed: Apr. 8, 1991

[51] Int. Cl.[5] ..... E04B 1/10

[52] U.S. Cl. ..... 52/284; 52/631

[58] Field of Search ..... 52/233, 311, 312, 285, 52/595, 284, 631, 300; 403/401, 402

[56] References Cited

U.S. PATENT DOCUMENTS

| | | | |
|---|---|---|---|
| 96,377 | 11/1869 | Anderson | 52/593 |
| 1,363,379 | 12/1920 | Wilson | 52/262 |
| 2,021,341 | 11/1935 | Ward | 52/233 |
| 2,232,905 | 2/1941 | Dyer | 52/300 |
| 2,505,789 | 5/1950 | Norquist | 52/631 |
| 2,728,479 | 12/1955 | Wheeler | 52/98 |
| 2,756,463 | 7/1956 | Clements | 52/631 |
| 3,347,048 | 10/1967 | Brown et al. | 52/595 |
| 3,557,840 | 1/1971 | Maybee | 52/809 |
| 4,627,204 | 12/1986 | Smith | 52/233 |

FOREIGN PATENT DOCUMENTS

| | | | |
|---|---|---|---|
| 2700076 | 7/1978 | Fed. Rep. of Germany | 52/631 |
| 124275 | 3/1919 | United Kingdom | 52/285 |
| 497288 | 12/1938 | United Kingdom | 403/402 |

*Primary Examiner*—James L. Ridgill, Jr.
*Attorney, Agent, or Firm*—Caesar, Rivise, Bernstein, Cohen & Pokotilow, Ltd.

[57] ABSTRACT

The siding for a building exterior may be double-sided, the siding being in the form of tongue and groove boards having a rough cut surface finish on one face and a log-profile on the other face. A corner block structure simulating traditional dovetail log joints may be used with the log-look face and provides a low cost, easily fabricated corner block particularly suited for ready installation to the exterior corners of a building, in finishing and protective relation therewith.

20 Claims, 2 Drawing Sheets

LOG-LOOK SIDING CORNER BLOCKS

TECHNICAL FIELD

This invention is directed to the field of wood finish buildings, and in particular to a log-look or rough finish siding, and to a protective and decorative corner block system, for use therewith.

BACKGROUND ART

Buildings built of log are traditional in many parts of the world. In such buildings logs are laid one upon the other in courses, and may comprise both the wall structure and the interior and exterior finish to the building.

More recently frame construction has supplanted the log, in terms of wall structure, while profiled boards having a pseudo log-look are used for both internal and external finish, more particularly externally.

While a sheathing of horizontally set log-look boards, frequently of material such as cedar, conveys an impression much akin to an original solid log structure, the external wall corner treatment in order to maintain an authentic log appearance has proved both bothersome, time consuming and costly.

One prior solution to this problem has been the provision of corner blocks of solid log material, having the inner end face of each segment of the "log" profiled to provide a close fit with the log profile of the underlying board to which the segment is attached by its end face.

In addition to the significant extent of profiling necessary to prepare the end face of each log block segment, the time required to secure the segments in stacked array, in attached relation to the respective "logs" of the wall is quite considerable, thus rendering the arrangement unduly costly.

DISCLOSURE OF INVENTION

One aspect of the present invention is the provision of a tongue-and-groove facing board, for use in surface finishing a building or portion thereof, having one face of the board with a longitudinally extending "log" profile, the reverse face thereof being "rough cut". The latter rough cut may be provided by re-sawing with band or other saws, or may utilize an original roughing cut when the boards are initially slabbed out. Use is frequently made of a rough cut board finish when such boards are applied vertically as a siding. The provision of an edge-radiused log profile of short radius provides a board of sufficient lateral stability that it may be used with the rough side outermost, and will tolerate angle nailing through the root of the tongue.

In a preferred embodiment the tongue portion of the board may be asymetrical, in that the tongue, while being of rectangular section, appears longer when seen from the rough sawn face than from the "log face". When the boards are assembled as a vertical siding with the rough face outermost, the arrangement results in a narrow architectural vertical channel, generally of about one quarter inch width, between the rough-cut board faces.

A further aspect of the present invention is the provision of a hollow corner block structure of half-cruciform arrangement which may be prefabricated or readily manufactured at the site.

The subject corner block structure, while having the appearance of an authentic double overlapped dovetail corner joint, secures readily and securely to the corner structure of a frame building, while affording a simple, concealed miter joint with the adjacent log wall surfaces.

The present invention further provides a system for fabricating and attaching a double overlapped dovetail corner joint to a building wherein attachment timbers may be secured in predetermined relation with the face of the building at a corner thereof, to receive a double overlapped corner joint construction in securely attached relation thereto.

The presently disclosed system may further provide a building framing arrangement wherein auxialliary nailing timbers are located within a hollow corner of the structure, to provide a nail-to base, to receive externally located corner attachment timbers in securely nailed relation thereto.

In one preferred embodiment both the auxiliary nailing timbers and the attachment timbers are standard two-by-fours, in single or doubled relation to form part of the building frame structure. Furthermore, the structure thus formed lends itself to the provision of standard sheathing in totally enclosing relation with the frame structure, inclusive of the auxiliary nailing timbers, to which the attachment timbers may be readily and precisely nailed by way of nailing through the sheathing.

The attachment timbers may be secured to the building face by alternative attachment means.

In a preferred "nail-less" construction, the log face board portions forming the side and end faces of each course of "log" of the corner block may be a unitary board having miter-cut ends, with tranverse V-grooves in the reverse, rough cut face. These grooves define between them the end face of the corner block.

The thus grooved board may then be folded into a unitary, U-shaped board form, the folded V-grooves being glued within the vee to provide glued miter joints within the corner block, and an unbroken outer "log" surface.

The present invention thus provides, for use in a building construction, a board for facing the building having a laterally protruding tongue extending along one edge thereof, a somewhat larger groove extending along the other edge thereof to receive an adjoining tongue in entered relation therein, one face of the board having the longitudinal edges thereof radiused to a short radius, leaving the major adjoining surface thereof substantially planar, with the visual appearance of a log, the other face of the board having a rough cut decorative appearance.

There is further provided a half-cruciform hollow corner block structure having a pair of box-like columns in adjoining corner-to-corner, right-angled relation, each column having a substantially vertical joist portion therein, a series of boards in mutually side-by-side stacked relation arranged to form an open U form, having the joist portion located in supporting closing relation in the mouth of the U-form.

It will be understood that tongue and groove connections will exist between the adjoining boards that form the "logs" of the corner block.

In assembling and fastening the open U-form board to an enclosed joist portion, the nails or long staples that may be used may be driven through the miter end faces of the corner block inner ends and into the joist portion, so as to position the fastener head portions in a concealed location, effectively invisible.

In the preferred embodiment the outward facing surfaces boards have the visual appearance of logs.

Also in the preferred embodiment the column joist portion is set back within the mouth of the U-form by a distance equal to the thickness of an attachment timber, generally being a two-by-four.

Thus, in an erection system in accordance with the present invention a two-by-four attachment timber is secured at a building corner in edge aligned flush relation with the adjoining faces of the building structure, to receive a hollow column construction in secured relation therewith, wherein side portions of the column construction are located in attached adjoining relation with the attachment timber.

In the preferred embodiment the attachment timber receives a two-by-four portion of the column in attached face-to-face adjoining relation therewith.

It will be understood, in practicing the present invention, that the preferred sequence of assembly may be varied. Also, while fastening of the timber elements is frequently referred to as "nailing", it will be understood that other form of fastening may include machine stapling as well as glueing, bonding or taping.

BRIEF DESCRIPTION OF DRAWINGS

Certain embodiments of the invention are described by way of illustration, without limitation of the invention thereto, reference being made to the accompanying drawings, wherein.

BEST MODE OF CARRYING OUT THE INVENTION

Figure 1:
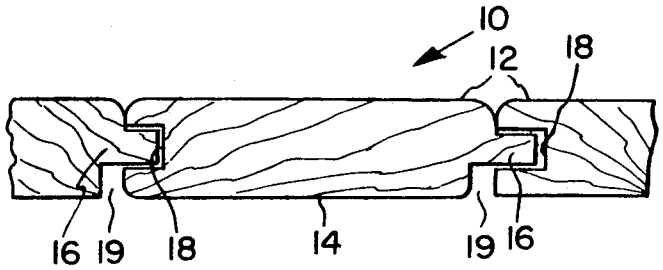
FIG. 1 is a cross section of a double sided log-profiled board in accordance with the present invention.

Referring first to FIG. 1, a double sided board section 10 has a log-look face 12 and a rough cut face 14. A tongue 16 and groove 18 complete the board, the groove 18 being sized to permit ready entry of a tongue 16 of an adjoining board 10 therein.

The board 10 may typically be of cedar having a nominal six inch width, one and one half inch nominal thickness, with three eighths inch radiused curves to form the "log" edges bounding the face 12.

The edges of the rough cut face 14 are slightly bevelled.

Figure 4:
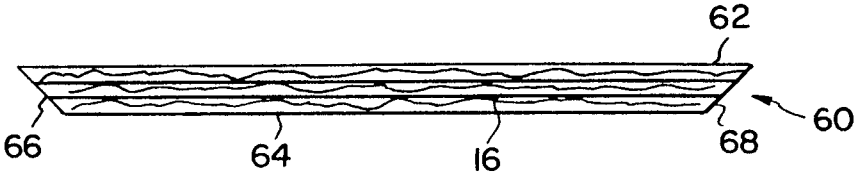
FIG. 4 is a side view of a corner block unitary board.
Figure 5:
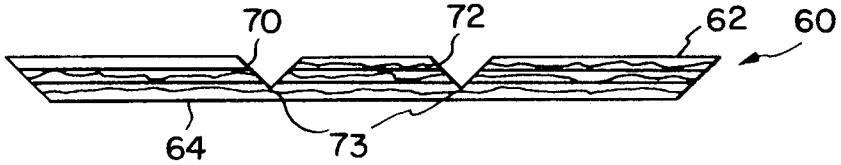
FIG. 5 is a side view of the FIG. 4 board, after lateral grooving.

Referring to the FIGS. 4 and 5 unitary board embodiment, the board siding 60 is shown having the rough cut face 62 uppermost, and the log look face 64 facing downwardly. The board edge tongue portion is shown.

The corner block boards 60 are each cut to length, the ends 66, 68 being mitered at 45 degrees. A pair of V-grooves 70, 72 are dado cut across the rough cut face 62, leaving a thin, uncut flexible root portion 73 to form a hinge.

Figure 6:
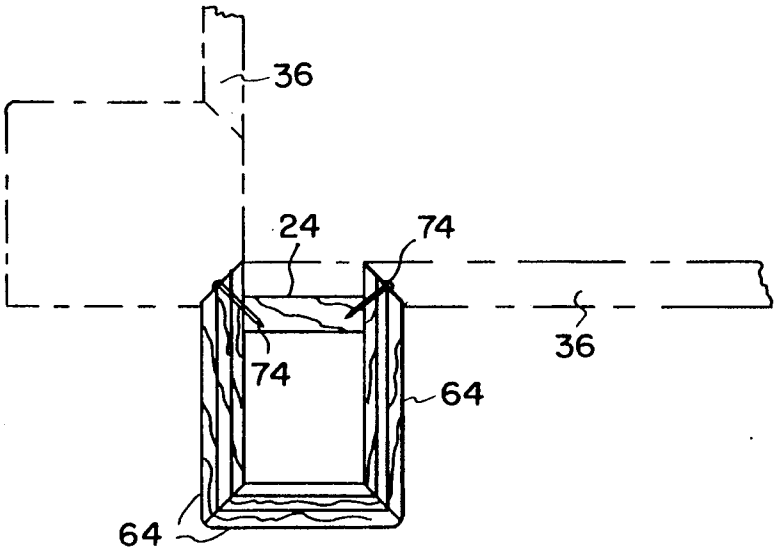
FIG. 6 shows the FIG. 5 board in final form, and having a joist portion assembled therewith.

In the case of cedar boards, the boards 60 may be cold folded to the u-form of FIG. 6. Other types of wood may require pre-steaming or soaking.

The interior joist portion 24 may be secured by nails or staples 74, driven, as shown, through the mitered ends 66, 68.

Upon installation of a thus formed corner block, the head portions of the nails or staples 74 are totally concealed adjacent the face of the building, by the abutting face board, which has a mitered end that mates in fully concealing relation with the corner block mitered end, where the heads of the nails or staples 74 are located.

In the case of the outer side of the corner block, adjacent the building corner, the mating half of the combined corner blocks provide complementary miter faces, to totally conceal any nails or staples that may be present therein.

It will be understood that the subject system lends itself equally to frame constructions of heavier sections, using two by six, two by eight studs, etc. In such instances the nailing timbers located within the interior of the wall are probably retained as two by four timbers.

Figure 2:
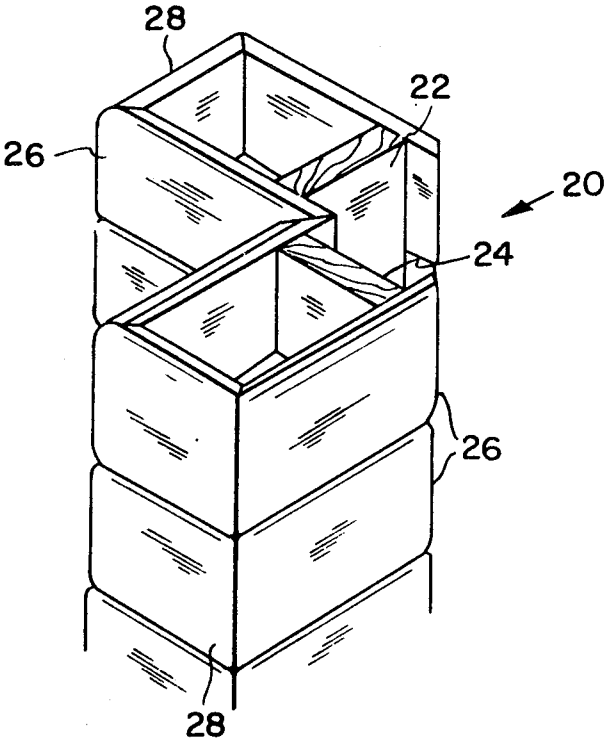
FIG. 2 is a perspective view of a portion of a hollow corner block column, structure in accordance with the invention; and, FIG. 3 is a plan view, in section, of a building corner portion having a column embodiment as shown in FIG. 2 secured thereto.

Referring to FIG. 2, the corner structure 20 comprises a pair of identical columns arranged in mutual corner wise relation to form the required half cruciform shape equivalent in appearance to a dovetail jointed log structure.

The respective joist portions 22, 24 preferably consist of two-by-four timbers, having side portions 26 and end portions 28 to form an enclosed box.

The ends of all the joints that are externally viewable are mitered. In the illustrated embodiment the joist portions 22, 24 are set back between the side portions 26 a distance equal to the actual thickness of a two-by-four timber, forming a recess to receive an attachment timber therein.

Figure 3:
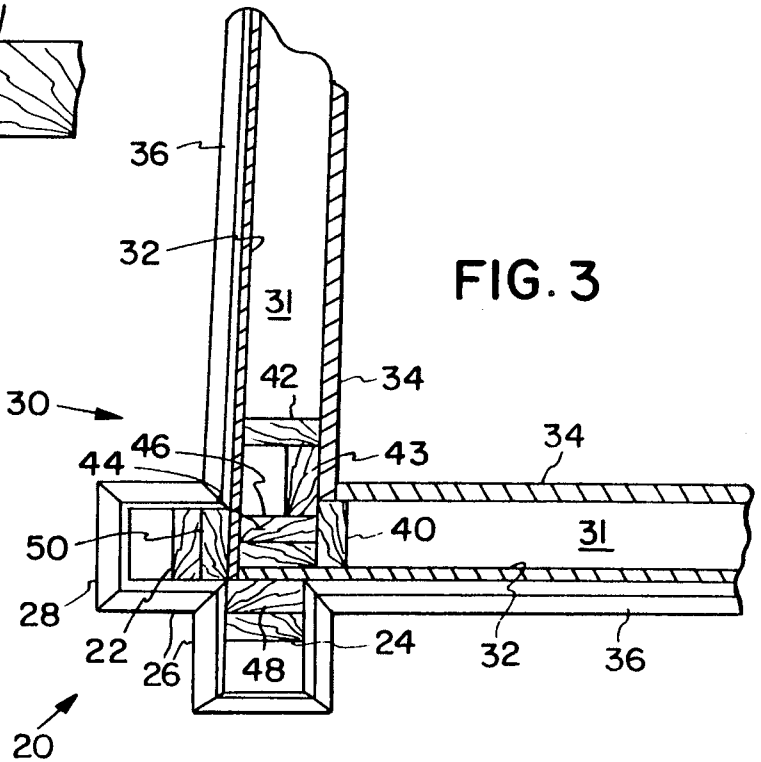

Referring to FIG. 3, a frame building corner 30 is shown, having a log-look corner construction 20 secured thereto.

The sheathed building, based on frame base members 31 is sheathed externally by sheets 32 and internally by sheets 34.

Enclosed within the envelope of the sheathing 32, 34 are framing two-by-fours 40, 42, 43.

Auxiliary nailing timbers 44, 46 comprise a pair of two-by-fours, and serve to locate the framing two-by-four 43, being all contained within the envelope of sheathing 32, 34.

Attachment timbers 48, 50 preferably by way of two by-four timber are located corner to corner with the external corner of the building 30 and nailed through the respective sheathing 32, 32, the nails penetrating into and being secured by the auxiliary nailing timbers 44, 46.

With the attachment timbers 48, 50 in place, the two pillars of construction 20 can be slid over the respective attachment timbers 48, 50 and nailed or otherwise secured into place.

In the case of final attachment to attachment timbers 48, 50, a construction staple driving machine may be readily employed within the hollow pillar constructions 20.

The use also is contemplated of upwardly protruding two-by-four toe pieces projecting out from the walls, to extend within the feet of the pillars of construction 20, in upward engaging relation respectively outwardly of the joist portions 22, 24. This toe piece provision then avoids the need for long reach internal nailing at the foot of the column.

The siding boards 35 have the ends thereof mitered so as to provide effectively invisible joints with the mitered inner ends of the pillar constructions 20. The tongue and groove construction of the boards 36 facilitates their installation without the evident presence of the securing nails, by the known expedient of nailing obliquely inwardly through the root of the tongue. The simple construction of the present invention lends itself to prefabrication , or to production at the job site. It will be understood that log profile boards other than the presently disclosed profile may also lend themselves to the present corner block structure.

In certain instances, particularly for on-the-site construction, the interior joist portions 22, 24 may be dispensed with, and the pillar side portions 25 directly attached to the attachment timbers 48, 50.

The pillar side members 26 and end members 28 generally are joined by cross-nailing, usually through the end member 28 and lengthwise into the side members 26. The assembly of the column box structure 20 may, optionally also include the additional provision of internal corner nailing strips, to simplify and strengthen the structure of the box pillars.

Referring to the FIG. 4 and 5 unitary board embodiment, the board siding 60 is shown having the rough cut face 62 uppermost, and the log look face 64 facing downwardly. The board edge tongue portion 65 is shown.

The corner block boards 60 are each cut to length, the ends 66, 68 being mitered at 45°. A pair of V-grooves 70, 72 are dado cut across the rough cut face 62, leaving a thin, uncut root portion 73 that forms a hinge.

In the case of cedar board material the boards 60 may be cold folded to the U-form of FIG. 6.

The interior joist portion 24 may be secured by nails or staples 74 inserted as shown through the mitered ends 66, 68.

Upon installation of a corner block thus formed, the nails of staples 74 are totally concealed against the face of the building and by the abutting face boards, which are miter jointed thereto, to complete the siding of the building.

It will be understood that the subject system equally lends itself to frame constructions of heavier section such as two by six, two by eight timbers etc. In such instances the nailing timbers located within the interior of the wall are probably maintained as two by four timbers.

INDUSTRIAL APPLICABILITY

The subject double-faced log profile boards and the log profile corner block structure have wide application for siding, particularly in frame housing.

We claim:

1. A double sided, dual purpose, exterior siding board of plain lumber having a log-profile surface on one face thereof and a rough cut finish on the other face thereof, having tongue and groove edges, at least one portion of said tongue and groove being undercut, to present an architectural channel on said rough cut face upon assembly of the board in tongue and groove assembled relation with an adjoining like board, and providing optional selection of an exterior surface having a log profile or a rough cut finish with architectural groove.

2. A siding board having a log profile surface on one face thereof, being of selected length, and having a pair of substantially V-shaped channels extending laterally thereacross a selected distance apart, each having a thin uncut portion of the board defining the root of the V-shaped channel and forming a hinge portion to permit bending of the board thereat into a unitary, substantially U-form having a joint free outer surface.

3. The siding as set forth in claim 2, said selected distance forming the base of said U-form; adjoining leg portions of said U-form being of equal length with each other and having mitered end faces.

4. The siding board as set forth in claim 3, including fastening means to secure said board portions in said U-form.

5. The siding as set forth in claim 4, said fastening means including adhesive material within said V-shaped channels securing said board portions in said U-form.

6. The siding board as set forth in claim 4, including an interior member adjacent the mouth of said U-form and secured in spacing relation between said leg portions.

7. The siding board as set forth in claim 6, said fastening means connecting said mitered end faces and said interior member.

8. A corner block structure for attachment to the corner of a building, to simulate dovetail log joints with overhang, comprising a hollow box-like rectangular pillar construction having a plurality of courses of simulated logs in mutually stacked relation, each said simulated log having two side members and one end member of unitary construction arranged in a U-form plan, and at least one interior member extending in closing relation between said side members, located adjacent the mouth of the U-form, having said side members in secured relation therewith said two sides and one end unitary construction providing a jointless outer surface to said U-form.

9. The structure as set forth in claim 8, said at least one interior member being set back between said side members to form a recess for entry, in use, of an attachment timber in substantially flush fitting relation therein.

10. The structure as set forth in 8 claim combination with a building, including log-profile siding boards secured to at least one face of the building in fitting relation with said structure.

11. The combination as set forth in claim 10, including an attachment timber secured to an external corner of the building in vertical, flush relation with adjoining faces of the building, having said pillar construction secured thereto.

12. The combination as set forth in claim 11, wherein said attachment timber comprises said at least one interior member.

13. The combination as set forth in claim 12, said building including nailing timbers within the wall structure thereof, positioned in relation to said corner to receive fasteners from said attachment timber in entered and secured relation therein.

14. The combination as set forth in claim 13, said nailing timbers comprising a pair of two-by-four timbers secured in mutual face to face relation abutting adjoining interior corner surfaces of said building, to receive fasteners penetrating each said corner surface, in entered securing relation therewith.

15. A building having laterally oriented sheathing boards, each with a log-look surface, secured to form exterior wall surfaces of the building; an outwardly protruding, downwardly extending attachment timber secured adjacent an external corner of the building; a first hollow rectangular box-like pillar construction secured in outwardly protruding relation from a corner of the building in attached concealing relation with said attachment timber, said pillar construction comprising a plurality of unitary log-look members each bent in a U-form, arranged in mutually stacked relation forming said pillar, said log-look sheathing boards secured to said wall adjoining said pillar construction stacked members being in substantial horizontally aligned relation with respective ones of said U-form members.

16. The building as set forth in claim 15, a plurality of said log look members forming said box-like pillar construction being cut as boards of required length; having a pair of V-shaped channels extending transversely of each of the boards extending in depth almost the full thickness of the board, each board being bent at said V-shaped channels to provide a U-form portion of said box like pillar construction, and having no visible fastening means.

17. The building as set forth in claim 15, including a second said pillar construction attached in adjoining relation with said first pillar construction, and extending away from the building at substantially 90 degrees from said first pillar construction.

18. The building as set forth in claim 17, including nailing timbers secured within the wall of said building in concealed relation therein, being located to receive fastening elements for said attachment timber in inserted and retained relation therein.

19. The building as set forth in claim 18, said box-like pillar construction having an end recess therein, to receive said attachment timber in flush fitting relation therein.

20. The building as set forth in claim 19, having miter joint faces at the outer ends of leg portions of said U-form, in an outwardly facing relation, having fastening means extending through said miter joint faces into the interior of said U-form in said secured relation with an interior member of said box like pillar structure.

* * * * *